United States Patent [19]

Miyauchi et al.

[11] Patent Number: 4,587,537

[45] Date of Patent: May 6, 1986

[54] HEAT-SENSITIVE RECORDING SHEET

[75] Inventors: Masahiro Miyauchi; Masahiro Higuchi, both of Tokyo, Japan

[73] Assignee: Mitsubishi Paper Mills, Ltd., Tokyo, Japan

[21] Appl. No.: 494,312

[22] Filed: May 13, 1983

[30] Foreign Application Priority Data

May 14, 1982 [JP] Japan ..... 57-82131
Jun. 1, 1982 [JP] Japan ..... 57-92154

[51] Int. Cl.[4] ..... B41M 5/18

[52] U.S. Cl. ..... 346/208; 346/209; 346/214; 346/216; 346/225; 427/150; 427/151

[58] Field of Search ..... 282/27.5; 427/150–152; 428/320.8, 411, 488, 537, 913, 914; 346/208, 209, 214, 216, 217, 225

[56] References Cited

FOREIGN PATENT DOCUMENTS 0005636 6/1978 Japan ..... 346/208
0041994 3/1982 Japan ..... 346/208

*Primary Examiner*—Bruce H. Hess
*Attorney, Agent, or Firm*—Cushman, Darby & Cushman

[57] ABSTRACT

In a heat-sensitive recording sheet having a heat-sensitive coating layer comprising a colorless to light-colored dye precursor as color former and benzyl p-hydroxybenzoate as color developer which causes said dye precursor to develop a color by reacting with said dye precursor when heated, the color development sensitivity of said sheet particularly at low temperatures is enhanced by allowing said heat-sensitive coating layer to further comprise a terephthalic acid ester having a melting point of 60° C. or higher and a wax having a melting point of 60° C. or higher.

3 Claims, No Drawings

HEAT-SENSITIVE RECORDING SHEET

BACKGROUND OF THE INVENTION

1. Field of the Invention

This invention relates to a heat-sensitive recording sheet having an ability of highly sensitive color development.

2. Description of the Prior Art

In recent years, the heat-sensitive recording method has come to possess various advantages such that it gives almost no impact and accordingly is noiseless, development and fixation is not required and equipment maintenance is simple. Therefore, the method is widely used not only in various printers and telephone facsimile but also in many other areas. In the field of the telephone facsimile, the heat-sensitive system has been popularized sharply, which is being improved to a faster speed type for reduction of transmission cost. To respond to the speed-up of facsimile, an increased sensitivity has come to be required for heat-sensitive recording materials.

In the facsimile of faster speed type, since a standard manuscript of an A4 size is transmitted and received in 20 sec to 1 min, electricity runs through a thermal head of the facsimile only for a very short period of time of 1 to 2 msec and a heat energy generated by the electricity is transmitted to a heat-sensitive recording sheet, whereby images are formed. In order to allow a heat energy transmitted in such a short period of time to conduct an image-forming reaction, there is needed a heat-sensitive recording sheet excellent in heat response. This requirement of excellent heat response does become more stringent particularly when the facsimile is used at a low temperature of 10° C. or below.

Ordinarily, heat-sensitive recording sheets contain, as essential components, a dye precursor and a color developer. A method for increasing the sensitivity of a heat-sensitive recording sheet by allowing the heat-sensitive coating layer of the sheet to contain a heat-meltable substance is disclosed in Japanese Patent Publication No. 4160/1968.

Heat-meltable substances have a function that, when they are melt by a heat energy transmitted, they dissolve or include a dye precursor or a color developer or both and they accelerate their color-developing reaction. However, these heat-meltable substances do not develop colors by themselves and cause various inconveniences such that they cause blotting or feathering in developed color portions or cover the developed color portions and thereby cause density reduction, namely dilution and further they produce work-ups or stickings. Accordingly, heat-meltable substances have a limitation in sensitivity-increasing effect when they are used alone.

Hence, there have been made studies for enhancing the heat response of dye precursors or color developers which are both directly related to color development. However, in the case of dye precursors, utilizable dye precursors are small in number at present considering from characteristics after color development, cost, manufacturing problems, etc., and selection of dye precursors having excellent heat response from among such a small number is difficult practically. On the other hand, in the case of color developers, it is known that benzyl p-hydroxybenzoate described in Japanese Patent Application Kokai (Laid-open) No. 74762/1979 has excellent heat response, but this compound has a drawback of giving unstable images. In the case of color developers, it is also known as described in Japanese Patent Publication No. 72996/1981 that inclusion of one or two or more kinds of terephthalic acid esters improves image stability and further is effective for heat sensitivity.

To respond to changes of recording equipments associated with the speed-up of recording speed as well as to a requirement of high density recording under a low temperature atmosphere of 10° C. or below, there have been desired the advent of a heat-sensitive recording sheet with increased color-development sensitivity particularly at low temperatures.

Even in high speed facsimile equipments, the pattern of transmitting heat energy onto a heat-sensitive recording sheet varies at times depending upon remittance modes, because there are cases that these high speed facsimile equipments are connected to low or medium speed facsimile equipments of older type for enabling their reciprocal communication. Specifically explaining, in the case of a low or medium speed remittance mode, a time for heat remittance becomes longer and therefore, when the energy quantity transmitted is fixed constant, the temperature of a thermal head which is a heat-generating element is controlled at a relatively low temperature or the scanning line density is reduced. This presents a very severe condition for high density recording at low temperature atmosphere.

SUMMARY OF THE INVENTION

An object of this invention is to provide a heat-sensitive recording sheet having improved the drawbacks of the prior arts and having an ability of highly sensitive color development particularly at low temperatures.

This and other objects and advantages of the invention may be readily ascertained by referring to the following description.

The object of this invention is achieved by, in a heat-sensitive recording sheet having a heat-sensitive coating layer comprising a colorless to light-colored dye precursor as color former and benzyl p-hydroxybenzoate as color developer which causes said dye precursor to develop a color by reacting with said dye precursor when heated, allowing said heat-sensitive coating layer to further comprise a terephthalic acid ester having a melting point of 60° C. or higher and a wax having a melting point of 60° C. or higher.

When the heat-sensitive coating layer of the above heat-sensitive recording sheet further comprises benzyl p-benzyloxybenzoate, the resulting heat-sensitive recording sheet has a remarkably improved color-developing ability particularly at low temperatures.

DETAILED DESCRIPTION OF THE PREFERRED EMBODIMENTS

Terephthalic acid esters and waxes used in the heat-sensitive recording sheet of this invention are restricted to those having a melting point of 60° C. or higher in order to prevent background fogging occuring in the drying process after application of a heat-sensitive coating layer on a substrate sheet.

Terephthalic acid esters having a melting point lower than 60° C. (for example, diethyl terephthalate having an m.p. of 43.2° C.) as well as waxes having a melting point lower than 60° C. (for example, lanolin having an m.p. of 36° to 40° C.) can not be used practically because these cause background fogging in the drying process after application of a heat-sensitive coating layer.

As terephthalic acid esters having a melting point of 60° C. or higher usable in this invention, there are mentioned, for example, monoethyl terephthalate (m.p. 165° C.), monopropyl terephthalate (m.p. 127° to 129° C.), monoisopropyl terephthalate (m.p. 166° C.), monobutyl terephthalate (m.p. 122° to 124° C.), monoisobutyl terephthalate (m.p. 151° to 154° C.), mono-n-octyl terephthalate (m.p. 82° to 84° C.), monocyclohexyl terephthalate (m.p. 160° to 162° C.), dimethyl terephthalate (m.p. 140° C.), di-t-butyl terephthalate (m.p. 118° C.), dicyclohexyl terephthalate (m.p. 75° to 80° C.), dimethyl 2-methylterephthalate (m.p. 73° C.), dimethyl 2-chloroterephthalate (m.p. 60° C.), dimethyl 2,5-dichloroterephthalate (m.p. 136° C.), diethyl 2-bromo-5-chloroterephthalate (m.p. 115° to 116.5° C.), diphenyl terephthalate (m.p. 191° C.), etc. As waxes having a melting point of 60° C. or higher usable in this invention, there are mentioned animal waxes such as beeswax, Chinese insect wax and the like; vegetable waxes such as candelilla wax, carnauba wax and the like; mineral waxes such as montan wax and the like; petroleum waxes such as paraffin wax, microcrystalline wax and the like; modified waxes such as a montan wax derivative, a paraffin wax derivative, a microcrystalline wax derivative and the like; hydrogenated waxes such as castor wax and the like; synthetic waxes such as a low molecular polyethylene, a derivative thereof and the like; amide type waxes such as saturated fatty acid amides (lauramide, stearamide, palmitamide, coconut acid amide, behenamide and the like), unsaturated fatty acid amides (oleamide, erucamide, ricinoleamide and the like), fatty acid amide derivatives (N-cyclohexylstearamide, N-cyclohexylpalmitamide, N-ethylstearamide, N-ethylpalmitamide, N-stearylstearamide, N-stearylbenzamide, N-stearylphenylacetamide, N-hydroxymethylstearamide, ethylenebis-stearamide and the like); and so forth. These can be used alone or in combinations of two or more as fine powders or as emulsions. Terephthalic acid esters and waxes are added preferably in an amount of 10 to 100% by weight and particularly preferably in an amount of 10 to 60% by weight, respectively, based on the amount of benzyl p-hydroxybenzoate which is a color developer.

Addition of terephthalic acid esters and waxes in excessive amounts is not desirable from the standpoint of cost, wastes heat energy transmitted, reduces the density of developed color portions (i.e. has dilution effect) because none of them develop a color by themselves, and further causes scums and sticks which give various damages.

According to this invention, benzyl p-hydroxybenzoate, a terephthalic acid ester having a melting point of 60° C. or higher and a wax having a melting point of 60° C. or higher are ground and dispersed separately or together in a grinder into fine particles and then are mixed with a dye precursor, a binder, a pigment, etc. which have all been ground and dispersed similarly and, if necessary, to the resulting mixture are added various additives such as a surfactant, a brightener and the like, whereby there is prepared a coating color.

According to another embodiment of this invention, in a heat-sensitive recording sheet having a heat-sensitive coating layer comprising a colorless to light-colored dye precursor as color former and benzyl p-hydroxybenzoate as color developer which causes said dye precursor to develop a color by reacting with said dye precursor when heated, said heat-sensitive coating layer can further comprise benzyl p-benzyloxybenzoate together with a terephthalic acid ester having a melting point of 60° C. or higher and a wax having a melting point of 60° C. or higher.

It is preferable that amounts of benzyl p-benzyloxybenzoate, the terephthalic acid ester and the wax added be 10 to 60% by weight, respectively, based on the amount of benzyl p-hydroxybenzoate and the total amount of these compounds do not exceed 1.2 times the amount of benzyl p-hydroxybenzoate.

In this case, addition of these compounds in excessive amounts is not desirable from the standpoint of cost, wastes heat energy transmitted, reduces the density of developed color portions (i.e. has dilution effect) because none of them develop a color by themselves, and further causes scums and sticks which give various damages.

In accordance with this embodiment of the present invention, benzyl p-hydroxybenzoate, benzyl p-benzyloxybenzoate, a terephthalic acid ester having a melting point of 60° C. or higher and a wax having a melting point of 60° C. or higher are ground and dispersed separately or together in a grinder into fine particles and then mixed with a dye precursor, a binder, a pigment, etc. which have all been ground and dispersed similarly and, if necessary, to the resulting mixture are added various additives such as a surfactant, a brightener and the like, whereby there is prepared a coating color.

Next, dye precursors, binders, pigments and substrates used in the heat-sensitive recording sheet of this invention will be explained.

(1) Dye Precursor

There can be used dye precursors which are employed generally in heat-sensitive papers. They are, for example, Crystal Violet Lactone, 3-diethylamino-7-methylfluoran, 3-diethylamino-6-chloro-7-methylfluoran, 3-diethylamino-6-methyl-7-chlorofluoran, 3-diethylamino-7-anilinofluoran, 3-diethylamino-7-(2-chloroanilino)fluoran, 3-dibutylamino-7-(2-chloroanilino)fluoran, 3-diethylamino-7-(3-chloroanilino)fluoran, 3-diethylamino-6-methyl-7-anilinofluoran, 3-(N-ethyl-p-toluidino)-6-methyl-7-anilinofluoran, 3-(N-methylcyclohexylamino)-6-methyl-7-anilinofluoran, 3-piperidino-6-methyl-7-anilinofluoran, etc.

(2) Binder

For example, starches, hydroxyethyl cellulose, methyl cellulose, polyvinyl alcohols, styrene-maleic anhydride copolymers, styrene-butadiene copolymers, polyacrylic amides, etc.

(3) Pigment

For example, diatomaceous earth, talc, kaolin, calcinated kaolin, calcium carbonate, magnesium carbonate, titanium oxide, zinc oxide, silicon oxide, aluminum hydroxide, urea-formaldehyde resin, etc.

(4) Substrate

Any of papers, synthetic papers, synthetic resin films, etc. can be used, however, papers are generally used.

Hereinunder, this invention will be explained more specifically by way of Examples, but the invention is not restricted by these Examples.

EXAMPLE 1

(1) Fluid A (dispersion of benzyl p-hydroxybenzoate)

| | |
|---|---|
| Benzyl p-hydroxybenzoate | 175 g |

-continued

| | |
|---|---|
| Malon MS-25 (25% aqueous solution of a sodium salt of a styrene-maleic anhydride copolymer, manufactured by Daido Kogyo K.K.) | 35 g |
| Water | 290 g |

The above mixture is ground and dispersed for 48 hr in a ball mill.

(2) Fluid B (dispersion of a terephthalic acid ester)

| | |
|---|---|
| Dimethyl terephthalate (m.p. 140 to 142° C.) | 175 g |
| 10% Aqueous solution of an ammonium salt of a styrene-maleic anhydride copolymer | 87.5 g |
| Water | 237.5 g |

The above mixture is ground and dispersed for 48 hr in a ball mill.

(3) Fluid C (dispersion of a dye precursor)

| | |
|---|---|
| 3-Diethylamino-6-methyl-7-anilino-fluoran | 200 g |
| Malon MS-25 | 24 g |
| Water | 276 g |

The above mixture is ground and dispersed for 48 hr in a ball mill.

(4) Fluid D (dispersion of a wax)

| | |
|---|---|
| Stearamide (manufactured by Kao Corporation, brand name Fatty Amide S, m.p. 103 to 105° C.) | 150 g |
| 10% Aqueous solution of an ammonium salt of a styrene-maleic anhydride copolymer | 75 g |
| Water | 275 g |

The above mixture is ground and dispersed for 48 hr in a ball mill.

Using the dispersion fluids A to D thus obtained, there was prepared a heat-sensitive coating color having the following composition.

| | |
|---|---|
| Calcium carbonate (manufactured by Shiraishi Kogyo Kaisha, Ltd., brand name PC) | 5 g |
| Fluid A | 17 g |
| Fluid B | 5.7 g |
| Fluid C | 6 g |
| Fluid D | 3.3 g |
| Aqueous solution containing 15% by weight of a polyvinyl alcohol | 22 g |
| Water | 23 g |

The coating color prepared above was coated on a base paper of 50 g/m$^2$ so that the coated quantity after drying became 6.8 g/m$^2$, and the coated paper was dried for 1 min at 60° C. to obtain a heat-sensitive paper.

EXAMPLE 2

A coating color was prepared in the same manner as in Example 1 except that dimethyl terephthalate used in Fluid B of Example 1 was replaced by monobutyl terephthalate (m.p. 122 to 124° C.). This coating color was coated on a base paper of 50 g/m$^2$ so that the coated quantity after drying became 6.8 g/m$^2$, and the coated paper was dried for 1 min at 60° C. to obtain a heat-sensitive paper.

EXAMPLE 3

A coating color was prepared in the same manner as in Example 1 except that stearamide used in Fluid D of Example 1 was replaced by ethylene-bis-stearamide (manufactured by Kao Corporation, brand name Kao Wax EB-F, m.p. 141° to 146.5° C.). This coating color was coated on a base paper of 50 g/m$^2$ so that coating quantity after drying became 6.8 g/m$^2$, and the coated paper was dried for 1 min at 60° C. to obtain a heat-sensitive paper.

COMPARATIVE EXAMPLES 1 to 3

Using Fluids A, B, C and D shown in Example 1 optionally, there were prepared heat-sensitive coating colors having the following compositions. Each of these coating colors was coated on a base paper of 50 g/m$^2$ so that the coated quantity after drying became a quantity shown in the following Table, and then the coated papers were dried for 1 min at 60° C. to obtain heat-sensitive papers.

| | Comparative Example | | |
|---|---|---|---|
| | 1 | 2 | 3 |
| Calcium carbonate PC | 5 g | 5 g | 5 g |
| Fluid A | 17 | 17 | 17 |
| Fluid B | — | 8.6 | — |
| Fluid C | 6 | 6 | 6 |
| Fluid D | — | — | 10 |
| Aqueous solution of 15% by weight of a polyvinyl alcohol | 17.9 | 22 | 22 |
| Water | 21.1 | 23.4 | 22 |
| Coated quantity, g/m$^2$ | 5.4 | 6.6 | 6.6 |

Performance Test 1

Heat-sensitive papers of Examples 1 to 3 and Comparative Examples 1 to 3 were subjected to calendering by the use of a super calender so that the Bekk smoothness of each paper became about 400 to 500 sec. Then, recordings were made for each paper in constant temperature rooms having the following fixed atmospheres by the use of Facom Fax 621 C which is a facsimile manufactured by Fujitsu Limited, and subsequently densities of developed colors were measured.

Test a: Record density at 18° C. (general room temperature)

Test b: Record density at 5° C. (low temperature for test).

For developed color portions of papers obtained in Test a, the following tests were conducted.

Test c: Image retention when an image has been retained for 24 hr in an atmosphere of 60° C.

Test d: Image retention when an image has been retained for 24 hr in an atmosphere of 40° C. and 90% relative humidity.

In the above tests, density measurement was made by the use of an amber filter of Sakura densitometer PDA 45.

The results are shown below.

| | Test a (Record density at 18° C.) | Test b (Record density at 5° C.) | Test c (Image retention %) | Test d (Image retention %) |
|---|---|---|---|---|
| Example 1 | 1.24 | 1.20 | 84.7 | 81.7 |
| Example 2 | 1.24 | 1.18 | 89.9 | 90.1 |
| Example 3 | 1.22 | 1.16 | 92.0 | 90.5 |
| Comparative Example 1 | 0.92 | 0.72 | 76.2 | 74.4 |
| Comparative Example 2 | 1.09 | 0.95 | 80.4 | 79.2 |
| Comparative Example 3 | 1.02 | 0.90 | 71.9 | 70.2 |

As obvious from the above table, among heat-sensitive papers using benzyl p-hydrobenzoate as a color developer, those using both a terephthalic acid ester having a melting point of 60° C. or higher and a wax having a melting point of 60° C. or higher show higher color development sensitivities than those using either or neither of said terephthalic acid ester and said wax. This trend is more striking in recordings in low temperature atmospheres.

Further, those of Examples 1 to 3 show superior results also in image retention.

EXAMPLE 4

(1) Fluid E (dispersion of benzyl p-hydroxybenzoate)

| | |
|---|---|
| Benzyl p-hydroxybenzoate | 175 g |
| Malon MS-25 (manufactured by Daido Kogyo K.K., 25% aqueous solution of a sodium salt of a styrene-maleic anhydride copolymer) | 35 g |
| Water | 290 g |

The above mixture is ground and dispersed for 48 hr in a ball mill.

(2) Fluid F (dispersion of benzyl p-benzyloxybenzoate)

| | |
|---|---|
| Benzyl p-benzyloxybenzoate | 175 g |
| 10% Aqueous solution of an ammonium salt of a styrene-maleic anhydride copolymer) | 87.5 g |
| Water | 237.5 g |

The above mixture is ground and dispersed for 48 hr in a ball mill.

(3) Fluid G (dispersion of a terephthalic acid ester)

| | |
|---|---|
| Dimethyl terephthalate (m.p. 140 to 142° C.) | 175 g |
| 10% Aqueous solution of an ammonium salt of a styrene-maleic anhydride copolymer) | 87.5 g |
| Water | 237.5 g |

The above mixture is ground and dispersed for 48 hr in a ball mill.

(4) Fluid H (dispersion of a wax)

| | |
|---|---|
| Stearamide (Manufactured by Kao Corporation, brand name Fatty Amide S, m.p. 103 to 105° C.) | 150 g |
| 10% Aqueous solution of an ammonium salt of a styrene-maleic anhydride copolymer) | 75 g |
| Water | 275 g |

The above mixture is ground and dispersed for 48 hr in a ball mill.

(5) Fluid I (dispersion of a dye precursor)

| | |
|---|---|
| 3-Diethylamino-6-methyl-7-anilinofluoran | 200 g |
| Malon MS-25 | 24 g |
| Water | 276 g |

The above mixture is ground and dispersed for 48 hr in a ball mill.

Using Fluids A to D thus obtained, there was prepared a heat-sensitive coating color having the following composition.

| | |
|---|---|
| Calcium carbonate (manufactured by Shiraishi Kogyo Kaisha, Ltd., brand name PC) | 5 g |
| Fluid E | 17 g |
| Fluid F | 5.7 g |
| Fluid G | 5.7 g |
| Fluid H | 3.3 g |
| Fluid I | 6 g |
| Aqueous solution containing 15% by weight of a polyvinyl alcohol | 24.5 g |
| Water | 24.8 g |

The coating color prepared above was coated on a base paper of 50 g/m$^2$ so that the coated quantity after drying became 7.4 g/m$^2$, and the coated paper was dried for 1 min at 60° C. to obtain a heat-sensitive paper.

EXAMPLE 5

A coating color was prepared in the same manner as in Example 4 except that dimethyl terephthalate used in Fluid G of Example 4 was replaced by monobutyl terephthalate (m.p. 122 to 124° C.). This coating color was coated on a base paper of 50 g/m$^2$ so that the coated quantity became 7.4 g/m$^2$, and the coated paper was dried for 1 min at 60° C. to obtain a heat-sensitive paper.

EXAMPLE 6

A coating color was prepared in the same manner as in Example 4 except that stearamide used in Fluid H of Example 4 was replaced by ethylene-bis-stearamide (manufactured by Kao Corporation, brand name Kao Wax EB-F, m.p. 141° to 146.5° C.). This coating color was coated on a base paper of 50 g/m$^2$ so that the coated quantity became 7.4 g/m$^2$, and the coated paper was dried for 1 min at 60° C. to obtain a heat-sensitive paper.

COMPARATIVE EXAMPLES 4 to 6

Using optionally Fluids E, F, G, H and I shown in Example 4, heat-sensitive coating colors having the following compositions were prepared. Each of these coating colors was coated on a base paper of 50 g/m$^2$ so that the coated quantity after drying became a quantity shown below, and the coated paper was dried for 1 min at 60° C., whereby each heat-sensitive paper was obtained.

| | Comparative Example | | |
|---|---|---|---|
| | 4 | 5 | 6 |
| Calcium carbonate PC | 5 g | 5 g | 5 g |
| Fluid E | 17 | 17 | 17 |
| Fluid F | — | 5.7 | 5.7 |
| Fluid G | 5.7 | — | 5.7 |
| Fluid H | 3.3 | 3.3 | — |
| Fluid I | 6 | 6 | 6 |
| Aqueous solution containing 15% by weight of a polyvinyl alcohol | 21.9 | 21.9 | 23.2 |
| Water | 23.1 | 23.1 | 24.4 |
| Coated quantity, g/m$^2$ | 6.6 | 6.6 | 7.0 |

Performance Test 2

Heat-sensitive papers of Examples 4 to 6 and Comparative Examples 4 to 6 were subjected to calendering by the use of a super calendar so that the Bekk smoothness of each paper became about 400 to 500 sec. Then, recordings were made for each paper in consant temperature rooms having the following fixed atmospheres by the use of Facom Fax 621 C which is a facsimile manufactured by Fujitsu Limited, and subsequently densities of developed colors were measured.

Test e: Record density at 18° C. (general room temperature)

Test f: Record density at 5° C. (low temperature for test)

Test g: Record density at 0° C. (low temperature for test).

In the above tests, density measurement was made by the use of an amber filter of Sakura densitometer PDA 45.

The results are shown below.

| | Test e (Record density at 18° C.) | Test f (Record density at 5° C) | Test g (Record density at 0° C) |
|---|---|---|---|
| Example 4 | 1.38 | 1.34 | 1.14 |
| Example 5 | 1.38 | 1.32 | 1.10 |
| Example 6 | 1.36 | 1.30 | 1.05 |
| Comparative Example 4 | 1.24 | 1.20 | 0.84 |
| Comparative Example 5 | 1.34 | 1.28 | 0.91 |
| Comparative Example 6 | 1.32 | 1.09 | 0.70 |

As is obvious from the above table, in heat-sensitive recording papers using benzyl p-hydroxybenzoate as a color developer, superior high-sensitive color development is attained by the combined use of benzyl p-benzyloxybenzoate, a wax having a melting point of 60° C. or higher and a terephthalic acid ester having a melting point of 60° C. or higher. This trend is more striking in recordings in low temperature atmospheres.

What is claimed is:

1. A heat-sensitive recording sheet having a heat-sensitive coating layer comprising a colorless to light-colored dye precursor as color former and benzyl p-hydroxybenzoate as color developer which causes said dye precursor to develop a color by reacting with said dye precursor when heated, in which said heat-sensitive coating layer further comprises, based upon the amount of benzyl p-hydroxybenzoate, from 10 to 60% by weight of a terephthalic acid ester having a melting point of 60° C. or higher, from 10 to 60% by weight of a wax having a melting point of 60° C. or higher and benzyl p-benzyloxybenzoate.

2. A heat-sensitive recording sheet according to claim 1, wherein the wax is a fatty acid amide or derivative thereof.

3. A heat-sensitive recording sheet according to claim 1, wherein the total amount of the terephthalic acid ester, the wax and benzyl p-benzyloxybenzoate does not exceed 1.2 times the amount of benzyl p-hydroxybenzoate.

* * * * *